US006773021B2

(12) United States Patent
Breuer et al.

(10) Patent No.: US 6,773,021 B2
(45) **Date of Patent: *Aug. 10, 2004**

(54) SLIDING DEVICE

(75) Inventors: Christian P. Breuer, Axams (AT); G. Scott Barbieri, Bristol, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/007,324

(22) Filed: Nov. 8, 2001

(65) Prior Publication Data

US 2003/0085537 A1 May 8, 2003

Related U.S. Application Data

(63) Continuation-in-part of application No. 09/733,626, filed on Dec. 8, 2000.

(51) Int. Cl.[7] ..... B62M 29/00
(52) U.S. Cl. ..... 280/14.21; 280/7.14
(58) Field of Search ..... 280/7.12, 7.13, 280/7.14, 7.15, 8, 9, 10, 13, 14.1, 14.14, 14.15, 14.22, 14.23, 14.25, 14.26, 14.21, 14.24, 14.27, 14.28, 11.12, 11.15, 11.18, 845, 28.14, 28.16

(56) References Cited

U.S. PATENT DOCUMENTS

| | | | | |
|---|---|---|---|---|
| 27,015 A | | 1/1860 | Wicks | |
| 31,043 A | | 1/1861 | Warner | |
| 31,797 A | | 3/1861 | Gibson | |
| 59,796 A | | 11/1866 | Elmer et al. | |
| 65,396 A | | 6/1867 | Ladd | |
| 310,923 A | | 1/1885 | Wardwell | |
| 601,013 A | * | 3/1898 | Evans | 280/11.12 |
| 657,822 A | | 9/1900 | Handwerk | |
| 660,752 A | * | 10/1900 | Evans | 280/11.12 |
| 1,051,614 A | | 1/1913 | Minish | |
| 1,066,445 A | | 7/1913 | Beardsley | |
| 1,350,929 A | | 8/1920 | McCarthy | |
| 1,394,629 A | * | 10/1921 | Leight, Jr. | 280/14.28 |
| 1,428,676 A | | 9/1922 | Barlow | |
| 1,551,620 A | | 9/1925 | Ricke | |
| 1,569,885 A | | 1/1926 | Robblee | |
| 1,601,105 A | | 9/1926 | Cameron | |
| 1,802,116 A | * | 4/1931 | Kinsley | 280/7.13 |

(List continued on next page.)

FOREIGN PATENT DOCUMENTS

| | | |
|---|---|---|
| CA | 762.342 | 7/1967 |
| CA | 946864 | 5/1974 |
| CA | 1282441 | 4/1991 |

(List continued on next page.)

OTHER PUBLICATIONS

Bideck News, 2 pages printed from www.bideck.com on Nov. 27, 2001.
Bideck News, 1 page printed from www.bideck.com on Dec. 14, 2001.

(List continued on next page.)

*Primary Examiner*—Brian L. Johnson
*Assistant Examiner*—Hau Phan
(74) *Attorney, Agent, or Firm*—Wolf, Greenfield & Sacks

(57) ABSTRACT

A spacer for a sliding device connects a deck to a runner. The spacer may allow relative rotation, pivoting and/or sliding of the deck and the runner. The sliding, pivoting and/or rotating may reduce the stresses experienced at the attachment points of the spacer and the deck or the spacer and the runner. The spacer arrangement may also provide a sliding device with a smoother ride.

56 Claims, 8 Drawing Sheets

U.S. PATENT DOCUMENTS

| | | | | |
|---|---|---|---|---|
| 2,181,391 | A | | 11/1939 | Burgeson et al. |
| 2,187,437 | A | | 1/1940 | Wanat |
| 2,188,080 | A | | 1/1940 | Grimm |
| 2,206,035 | A | | 7/1940 | Hammond |
| 2,258,046 | A | | 10/1941 | Clement |
| 2,354,627 | A | | 7/1944 | Wheeler |
| 2,357,928 | A | | 9/1944 | Bowen et al. |
| 2,414,244 | A | | 1/1947 | Roth |
| 2,492,965 | A | | 1/1950 | Carr |
| 2,526,100 | A | | 10/1950 | Weirick |
| 2,547,209 | A | | 4/1951 | Holbrook |
| 2,568,070 | A | | 9/1951 | Holbrook |
| 2,661,219 | A | | 12/1953 | Coulson, Jr. |
| 2,666,652 | A | | 1/1954 | Lammers et al. |
| 2,750,198 | A | | 6/1956 | Moore et al. |
| 3,030,123 | A | | 4/1962 | Dworak |
| 3,145,029 | A | | 8/1964 | Ollanketo |
| 3,147,020 | A | | 9/1964 | Dahl |
| 3,260,531 | A | | 7/1966 | Heuvel |
| 3,260,532 | A | | 7/1966 | Heuvel |
| 3,276,785 | A | | 10/1966 | Tonelli |
| 3,332,697 | A | | 7/1967 | Hagen |
| 3,343,847 | A | | 9/1967 | Christy |
| 3,370,862 | A | | 2/1968 | Huffnagle |
| 3,378,275 | A | | 4/1968 | Rockwood et al. |
| 3,414,284 | A | | 12/1968 | Rosekrans, Jr. et al. |
| 3,436,088 | A | | 4/1969 | Kunselman |
| 3,578,351 | A | | 5/1971 | McAtee |
| 3,580,592 | A | | 5/1971 | Schrecengost |
| 3,583,722 | A | | 6/1971 | Jacobson |
| 3,628,804 | A | | 12/1971 | Carreiro |
| 3,751,062 | A | | 8/1973 | White, Sr. |
| 3,782,744 | A | | 1/1974 | Milovich et al. |
| 3,782,745 | A | | 1/1974 | Stoveken |
| 3,795,409 | A | | 3/1974 | Cudmore |
| 3,797,844 | A | | 3/1974 | Smolka et al. |
| 3,802,714 | A | | 4/1974 | Freegard |
| 3,862,766 | A | | 1/1975 | Bogdanovich |
| 3,900,204 | A | | 8/1975 | Weber |
| 3,945,655 | A | | 3/1976 | Banks et al. |
| 3,982,597 | A | | 9/1976 | Callaway |
| D243,263 | S | | 2/1977 | Koblick |
| 4,043,565 | A | | 8/1977 | Mogannam |
| 4,068,861 | A | | 1/1978 | Zemke, Jr. |
| 4,114,913 | A | | 9/1978 | Newell et al. |
| 4,116,455 | A | | 9/1978 | Dotson et al. |
| 4,138,128 | A | | 2/1979 | Criss |
| 4,139,214 | A | | 2/1979 | Meyer |
| 4,141,570 | A | | 2/1979 | Sudmeier |
| 4,160,552 | A | | 7/1979 | Kupka |
| 4,161,323 | A | | 7/1979 | Wetteland |
| 4,161,324 | A | | 7/1979 | Colvin |
| 4,163,565 | A | | 8/1979 | Weber |
| 4,165,091 | A | | 8/1979 | Chadwick |
| 4,175,759 | A | | 11/1979 | Strunk |
| 4,194,753 | A | | 3/1980 | Schrishuhn, Jr. |
| 4,221,394 | A | | 9/1980 | Campbell |
| 4,225,145 | A | | 9/1980 | Carr |
| 4,230,330 | A | | 10/1980 | Muhammad |
| 4,244,593 | A | | 1/1981 | Malone |
| 4,305,603 | A | | 12/1981 | Muller et al. |
| 4,398,734 | A | | 8/1983 | Barnard |
| 4,403,785 | A | | 9/1983 | Hottel |
| 4,433,855 | A | | 2/1984 | Wyke |
| 4,521,029 | A | | 6/1985 | Mayes |
| 4,606,548 | A | | 8/1986 | Little |
| 4,725,069 | A | | 2/1988 | Stampacchia et al. |
| 4,784,233 | A | | 11/1988 | Favors |
| 4,804,200 | A | | 2/1989 | Kuchler |
| 4,848,781 | A | | 7/1989 | Dykema et al. |
| 4,896,893 | A | | 1/1990 | Shumays et al. |
| D317,036 | S | | 5/1991 | Crivello |
| 5,018,760 | A | | 5/1991 | Remondet |
| 5,129,668 | A | * | 7/1992 | Hecht ..... 280/607 |
| D333,172 | S | | 2/1993 | Body |
| 5,249,816 | A | | 10/1993 | Southworth |
| 5,280,943 | A | | 1/1994 | Commier et al. |
| 5,285,742 | A | | 2/1994 | Anderson |
| 5,393,086 | A | | 2/1995 | LeMasson et al. |
| 5,397,150 | A | | 3/1995 | Commier et al. |
| 5,398,957 | A | | 3/1995 | Leighton et al. |
| 5,447,322 | A | | 9/1995 | Masson et al. |
| 5,458,351 | A | | 10/1995 | Yu |
| 5,547,204 | A | | 8/1996 | Gamzo |
| D375,772 | S | | 11/1996 | Riggs et al. |
| 5,580,077 | A | | 12/1996 | Dodge |
| 5,613,695 | A | | 3/1997 | Yu |
| 5,649,722 | A | | 7/1997 | Champlin |
| 5,820,154 | A | | 10/1998 | Howe |
| 5,970,631 | A | | 10/1999 | Inman |
| 6,006,451 | A | | 12/1999 | Morris et al. |
| 6,041,525 | A | | 3/2000 | Kelley |
| 6,113,113 | A | | 9/2000 | Longonl et al. |
| 6,113,116 | A | | 9/2000 | Stanton et al. |
| 6,113,508 | A | | 9/2000 | Locarno et al. |
| 6,115,946 | A | | 9/2000 | Morris et al. |
| 6,131,939 | A | | 10/2000 | Fels |
| 6,139,031 | A | | 10/2000 | Wingard |
| D448,441 | S | | 9/2001 | Wolf |
| 2002/0008360 | A1 | | 1/2002 | Ellington |

FOREIGN PATENT DOCUMENTS

| | | | | |
|---|---|---|---|---|
| DE | 1075477 | | 2/1960 | |
| DE | 79 00 648 | | 5/1979 | |
| FR | 929.149 | | 12/1947 | |
| FR | 2405722 | | 5/1979 | |
| FR | 2420984 | | 10/1979 | |
| FR | 2423243 | | 11/1979 | |
| FR | 2428452 | | 1/1980 | |
| JP | 53-73071 | | 11/1976 | |
| JP | 55-70176 | | 11/1978 | |
| JP | 55-35607 A2 | | 3/1980 | |
| JP | 10-258148 | | 9/1998 | |
| JP | 2002-35197 | * | 2/2002 | ..... A63C/5/00 |
| WO | WO 00/71213 A1 | | 11/2000 | |

OTHER PUBLICATIONS

Sno–Sk8, Sno–Sk8.com, printed from www.sno–sk8.com on Oct. 20, 2000.

Utility Model Technical Assessment of Japanese Utility Model Application No. 007950/2001.

European Search Report from European Patent Application No. 01 128 472.6–2318.

European Search Report from European Patent Application No. 01 128 471.8–2318.

* cited by examiner

SLIDING DEVICE

This application is a continuation-in-part of U.S. application Ser. No. 09/733,626, filed Dec. 8, 2000. U.S. application Ser. No. 09/733,626 is hereby incorporated by reference in its entirety.

FIELD OF THE INVENTION

The present invention relates to sliding devices for use on snow, ice, sand or other surfaces.

DESCRIPTION OF RELATED ART

There has been a desire amongst snowsports enthusiasts to perform tricks similar to those performed with a typical skateboard. For example, snowboards have been used to perform skateboard-type tricks, such as half pipe and quarter pipe maneuvers and the like. Bindings fixed in place on the snowboard secure the rider's feet so that the rider can maneuver the board, e.g., tilt the board on edge to execute a turn. However, the bindings prevent the rider from freely moving his or her feet on the board, which in turn prevents the rider from performing some tricks, such as those common among skateboard riders.

SUMMARY OF THE INVENTION

In an illustrative embodiment of the invention, a sliding device for supporting a rider when sliding on a surface includes a runner having an upper surface, first and second ends, and an intermediate portion between the ends. The sliding device further includes a deck elevated from the runner, the deck having a front to back direction, an upper surface that supports a rider, and a lower surface. The sliding device also comprises a first spacer secured to the runner at a runner attachment position and secured to the deck at a deck attachment position so that forces applied by a rider on the deck are transmitted to the runner, and so that the deck is not free to pivot about an axis running in the front to back direction. The spacer is constructed and arranged to allow pivoting of the runner and the deck in a front to back direction. In one embodiment, the runner has a length that is at least approximately ⅔ of the length of the deck. In another embodiment, the width of at least a portion of the deck is greater than the width of the runner. In another embodiment, at least two spacers interconnect the deck and runner.

In another illustrative embodiment of the invention, a sliding device for supporting a rider when sliding on a surface includes a runner having first and second ends and an intermediate portion between the ends. A deck is elevated from the runner, the deck having an upper surface that supports a rider and a front to back direction. The width of at least a portion of the deck is greater than the width of the runner. A first spacer is secured to the runner at a runner attachment position and secured to the deck at a deck attachment position so that forces applied by a rider on the deck are transmitted to the runner. The spacer is constructed and arranged to allow movement of the runner relative to the deck in a front to back direction during riding when one of the runner and the deck is flexed In one embodiment, the spacer is constructed and arranged to allow front to back movement without the runner attachment position varying relative to the runner and the deck attachment position varying relative to the deck. In another embodiment, a second spacer is secured to the runner and the deck.

In another illustrative embodiment of the invention, a spacer is provided in a bi-level sliding device having a deck and a runner that extend in a front to back direction. The spacer includes a first portion constructed and arranged to attach to the deck, and a second portion constructed and arranged to be attached to a runner and secured to the first portion such that forces applied by a rider on the deck may be transmitted to the runner. One of the first portion and the second portion includes a channel and part of the other of the first portion and the second portion is arranged to move in the channel to allow for movement of one of the deck and the runner relative to the other.

In another illustrative embodiment of the invention, a spacer is provided in a bi-level sliding device having a deck and a runner that extend in a front to back direction. The spacer includes at least two interlocking portions constructed and arranged to interconnect the deck and the runner and to provide an axis of rotation that is substantially horizontal and substantially perpendicular to the front to back direction of the deck and the runner. At least a portion of one of the interlocking portions in the spacer is free to slide relative to another interlocking portion.

In another illustrative embodiment of the invention, a spacer is provided in a bi-level sliding device having a deck and a runner that extend in a front to back direction. The spacer includes first and second interlocking portions forming an axis of rotation, the first interlocking portion having at least one shaft element that engages with the second interlocking portion. The shaft element is inserted into the second interlocking portion by deforming at least part of the first interlocking portion.

In another illustrative embodiment of the invention, a method of producing a bi-level sliding device includes the steps of providing a runner and a deck wider than the runner, providing two spacers, attaching a first spacer to the runner and the deck, and attaching a second spacer to the runner and the deck at runner and deck attachment positions such that the deck may move horizontally relative to the runner without a change in the runner and deck attachment positions relative to the runner and the deck.

In another illustrative embodiment of the invention, a method of producing a bi-level sliding device includes the steps of providing a runner and a deck wider than the runner, providing two spacers, attaching a first spacer to the runner and the deck, and attaching a second spacer to the runner and the deck at runner and deck attachment positions such that a portion of the deck may pivot relative to the runner in a front to back direction, and such that the deck is restrained from pivoting about an axis running in the front to back direction.

BRIEF DESCRIPTION OF THE DRAWINGS

The invention will be appreciated more fully with reference to the following detailed description of illustrative embodiments, when taken in conjunction with the accompanying drawings, wherein like reference characters denote like features, and in which.

DETAILED DESCRIPTION

Figure 1:
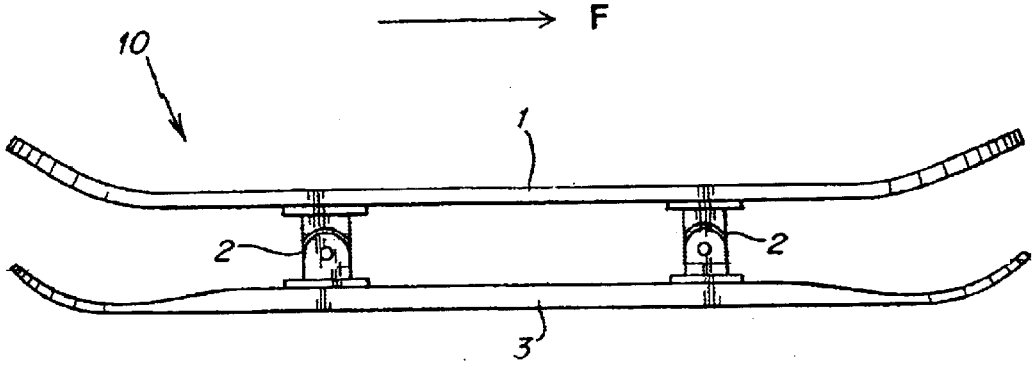
FIG. 1 is a side view of an illustrative embodiment in accordance with the invention.

Illustrative embodiments of the invention provide spacers or other connection arrangements for a sliding device that may be ridden by standing on the deck in much the same way as a typical skateboard. In one illustrative embodiment, a snowdeck has a bi-level design with spacers connecting a top portion to a bottom portion. The top portion is a deck on which the rider may stand in an upright position. Via one or more spacers, the top deck is connected to and vertically spaced from the bottom portion, which is a sliding portion, or runner, that contacts the sliding surface. Thus, for example, the snowdeck may be turned on the sliding surface, such as a snow-covered slope, by tilting the deck with one's feet, somewhat similar to that in skateboarding. The deck can be tilted and the snowdeck steered by the rider shifting weight between her toes and heels on the deck. By tilting the snowdeck to one side or the other, the rider can cause the deck and attached runner to pivot about an edge and execute a turn like that in skiing or snowboarding. However, because the deck is vertically spaced from the runner, the rider can tilt the snowdeck without requiring bindings that secure the rider's feet to the deck.

During riding, a sliding device such as a snowdeck may experience a variety of forces, torques and stresses, and various components of the sliding device may be affected by these forces. For example, the deck and/or runner may be bent or twisted when the sliding device hits a rock or bump. Less shocking, but equally large and/or damaging forces may be experienced when riding over curved sliding surfaces. Some of the forces may be absorbed by the rider, but the sliding device may be required to absorb many of these shocks and forces. A stiff or rigid attachment of the runner to the deck with spacers may cause certain portions of the sliding device to experience high stresses. Particularly susceptible to these stresses may be attachment points where the spacers are attached to the runner and the deck. High stresses or prolonged exposure to lower stresses may cause the connection between the deck, spacers and/or runner to fail, or the stresses may otherwise degrade or damage components of the sliding device.

In accordance with one aspect of the invention, a spacer may allow movement, such as pivoting or sliding, between the deck and runner to help reduce the stresses experienced during riding by the spacers and/or at the attachment points where the spacers are attached to the deck or runner. Sliding movement may be relative movement along any suitable path, such as linear, curved, or other. A spacer may provide, for example, relative pivoting, relative sliding, or any combination of movements between the deck and runner. Thus, the spacers may provide a type of suspension between the deck and the runner, allowing a smoother ride, a reduction in vibrations, or a reduced chance of damage to the sliding device.

In one aspect of the invention, where relative pivoting between the deck and runner is provided, a spacer, attached between the deck and the runner, may have portions which pivot relative to each other so that a section of the deck is allowed to pivot relative to a section of the runner. For example, in one embodiment, an axis of rotation is provided in a horizontal plane and portions of the deck and/or runner may pivot in a front to back direction. As forces are applied to the deck or runner, one or more of the spacers may allow the angle between the portions of the deck and runner to vary. The ability of the deck and runner to pivot may help to alleviate the stresses experienced when forces are applied to the sliding device. Of course, the axis of rotation could be in a different plane or orientation, and a spacer may provide more than one axis of rotation.

In another aspect of the invention, the spacer may be arranged such that the deck and runner may move relative to each other, but relative pivoting of the deck and runner around the front to back axis is prevented. Thus, for example, when a rider exerts a tilting force on one of the lateral edges of the deck, the deck may not pivot around an axis that extends in the front to back direction to any great extent relative to the runner. However, when the sliding device experiences various forces, longitudinal or lateral movement and/or pivoting of the deck relative to the runner is possible. Such an attachment may provide the responsiveness of a rigid attachment while allowing relative movement and greater flexing of the runner and/or deck, or may provide a shock absorbing function.

In another aspect of the invention, one or more spacers may be arranged such that longitudinal and/or lateral movements may be combined with relative pivoting to help reduce stresses experienced by the sliding device. For example, a spacer may provide both relative pivoting and sliding of the deck and runner. The pivoting and sliding permitted by the spacer may be completely independent of each other or related to one another. For example, in an embodiment where the pivoting and sliding are related, two portions of a spacer may slide relative to each other along a curved channel such that as the deck slides longitudinally relative to the runner, the deck also pivots relative to the runner. In some embodiments, one spacer may provide pivoting and another spacer may provide horizontal or other linear movement.

For clarity and ease of reference, a sliding device in accordance with embodiments of the invention is referred to as a "snowdeck" for use on snow. However, the sliding device may be used on other surfaces, such as ice, sand, plastic, metal and so on. An example of such a sliding device is described in a related U.S. Patent Application entitled "Sliding Device", filed on Dec. 8, 2000 with application Ser. No. 09/733,626. Thus, in accordance with the invention, although spacers are described below in connection with a snowdeck, the spacers are not limited to use with a snowdeck. Consequently, the use of spacers with other sliding devices is also contemplated. The above-mentioned aspects are merely representative of some of the aspects of the spacers and the sliding device, and the presence or lack of one or more of the above aspects should not be considered a limitation on the spacers and/or the sliding device.

Figure 2:
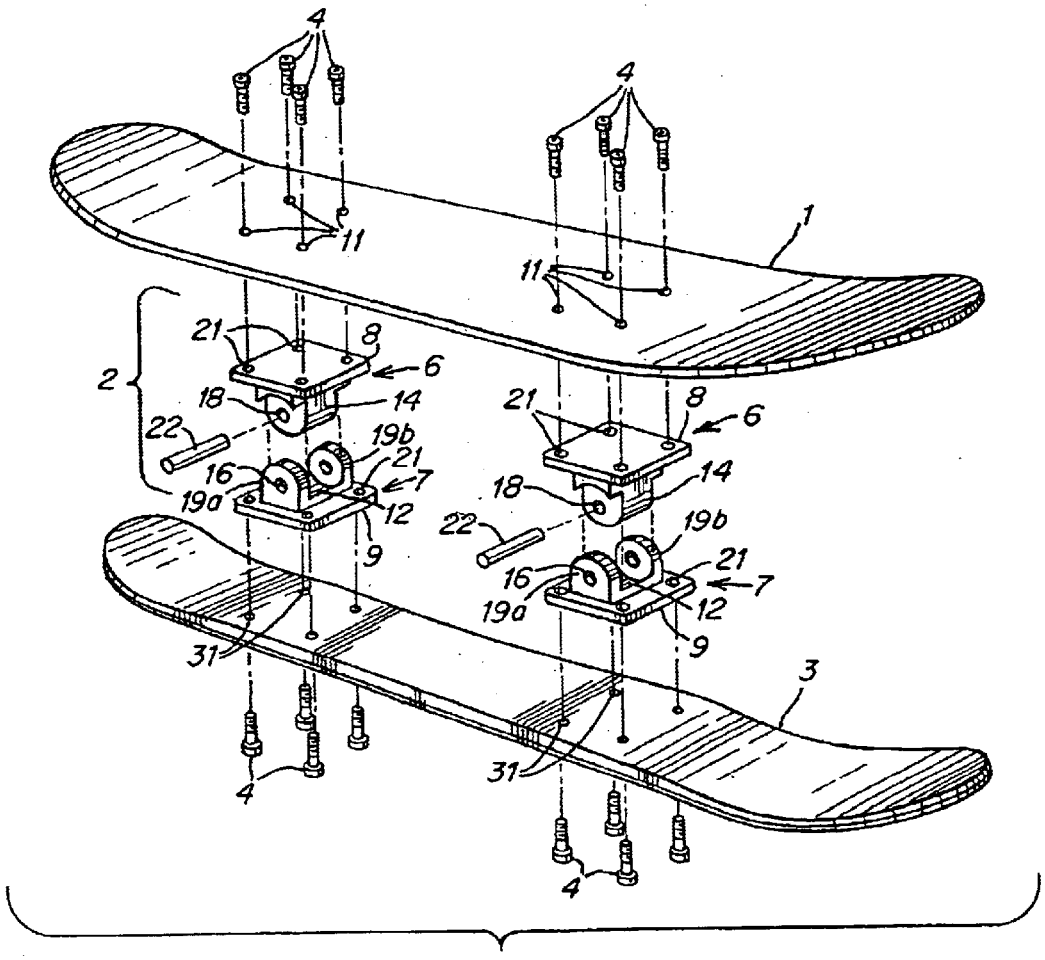
FIG. 2 is an exploded perspective view of the FIG. 1 embodiment.

One illustrative embodiment of a snowdeck 10 in accordance with the invention is shown in FIGS. 1 and 2. The snowdeck 10 includes a deck 1 that is attached to a lower sliding portion, or runner 3, by spacers 2. The runner 3 may be at least approximately ⅔ or ¾ the length of the deck 1, and a ratio of the width of the runner 3 to the width of the deck may be between 0.4 and 0.8. In this illustrative embodiment, the snowdeck 10 includes two spacers 2 that may pivot in response to forces on the snowdeck 10. For example, the spacers 2 may allow portions of the deck and runner attached to a spacer 2 to pivot relative to each other in a front to back direction, for example, around an axis transverse to the longitudinal axis of the snowdeck 10 (i.e., an axis running lengthwise along the snowdeck 10 as shown by arrow F). The spacers 2 may also allow the ends and midsection of the deck 1 and/or runner 3 to pivot or flex relative to the other. As a result, if the runner 3 or deck 2 experiences dynamic forces that urge the deck 2 or runner 3 to bend around an axis transverse to the longitudinal axis, the deck 2 or runner 3 may bend without the spacer 2 transmitting at least some bending forces that would be transmitted if the spacer was inflexible or otherwise constructed. However, the sections of the deck 1 near an attachment point to a spacer 2 may not be free to pivot around the front to back axis (extending lengthwise along the snowdeck 10) relative to a section of the runner 3 attached to the same spacer 2. Such an attachment between the deck 1 and the runner 3 may provide a more responsive snowdeck 10 because tilting forces on the deck 1 can be transferred more directly to the runner 3. The attachment of the deck 1 to the runner 3 need not entirely prevent pivoting around the front to back axis, but rather may allow a certain degree of pivoting of the deck 1 or runner 3 around the front to back axis of the snowdeck.

FIG. 2 shows a more detailed, exploded view of the attachment between the deck 1, runner 3 and spacers 2 in the FIG. 1 embodiment. In this illustrative embodiment, each spacer 2 includes a top portion 6 and a bottom portion 7 which are pivotally connected by a shaft 22. The shaft 22 is inserted through boreholes 16 and 18 in the bottom spacer portion 7 and the top spacer portion 6, respectively. The shaft 22 may be rigid, or somewhat flexible to permit limited movement between the two spacer portions 6 and 7. As discussed above, the ability of the spacer portions 6 and 7 to pivot relative to each other may allow sections of the deck 1 and runner 3 to pivot relative to each other. Although in this embodiment the spacers 2 have two portions 6 and 7, the spacers 2 are not limited to two portions and may include any suitable number of portions, including one unitary element. Furthermore, any suitable number of spacers 2 may be used in the snowdeck 10, and the spacers 2 may be different from each other. For example, one spacer 2 such as that shown in FIG. 2 and one non-pivoting spacer may be used.

In this illustrative embodiment, the deck 1 may be secured to the top portion 6 of the spacers 2 by bolts 4 that extend through holes 11 in the deck 1 to engage with the baseplate 8 of the top portion 6 at holes 21. Threads on the bolts 4 may engage with a threaded insert, nut or other feature at the holes 21 and may be tightened to securely hold the top portion 6 of the spacers 2 to the deck 1. The bolt 4 and spacer 2 arrangement may be formed to accommodate different decks 1 so that a rider may remove the deck 1 from the snowdeck 10 and replace it with another. Similarly, the runner 3 is secured to the bottom portion 7 of the spacers 2 by bolts 4 that extend through holes 31 in the runner 3 to engage with the baseplate 9 of the bottom portion 7 at holes 21. The bolt 4 and spacer 2 arrangement may be formed to accommodate different runners 3 and/or different spacers 2, so that a rider may remove various components from the snowdeck 10 and replace them with other components. Further, the deck 1, runner 3, and spacers 2 may be attached using tool-free devices to allow quick adjustment of the attachments between the various components. The spacer portions 6 and 7, the deck 1 and runner 3 may be attached using any suitable method, such as adhesive, unitary molding of the top or bottom portions 6 or 7 with the deck 1 or runner 3, respectively, welding, and so on as the method of attachment is not necessarily a limiting aspect of the invention.

In this embodiment, the top portion 6 may have an insertion piece 14 that extends downwardly from the baseplate 8, and be received between a pair of protuberances 19*a* and 19*b* that extend upward from the baseplate 9 of the bottom portion 7. The boreholes 16 in the protuberances 19*a* and 19*b* may be aligned with the borehole 18 in the insertion piece 14 so that the shaft 22 may be inserted. A support 12 between the protuberances 19*a* and 19*b* may be contoured to fit closely with the insertion piece 14 and to allow pivoting of the insertion piece 14 around the shaft 22. Similarly, the upper ends of the protuberances 19*a* and 19*b* may be contoured to fit closely with outer portions of the insertion piece 14. The close fit may allow a portion of the insertion piece 14 to bear on the support 12 and/or portions of the protuberances 19*a* and 19*b* to bear on the outer portions of the insertion piece 14, e.g., in the case of high static or dynamic loading of the spacers 2. For example, the shaft 22 may support light vertical loads while the insertion piece 14 and support 12 provide additional support when the loading is larger. Of course, the shaft 22 may bear all of the vertical forces on the spacer 2.

The interlocking arrangement of the top and bottom portions 6 and 7 may help to prevent twisting of the deck 1 and/or runner 3 around a vertical axis perpendicular to the deck 1 and runner 3. For example, the insertion piece 14 may fit closely between the protuberances 19*a* and 19*b* so that relative twisting of the top and bottom portions 6 and 7 around a vertical axis is resisted. A suitable fit of the shaft 22 with the boreholes 16 and 18 may also help resist such twisting.

The boreholes 16 and 18 may be provided with bearings, such as ball bearings or roller bearings, to reduce wear and/or allow more free movement. Alternately, the boreholes 16 and 18 may have surfaces with predetermined coefficients of friction to provide increased or decreased resistance to pivoting motions, e.g., to dampen pivotal movement at all or selected frequencies. The spacer portions 6 and 7, as well as the shaft 22, may be made of any suitable material such as, for example, plastic, wood or metal. As will be evident to one of skill in the art, the shaft 22 need not be cylindrical, nor is it required to be formed of a single element. Separate shaft elements for each of the boreholes 16 may be employed. A shaft 22 is not necessarily required as the spacer 2 can be made as a single unitary element or provided with the ability to pivot in another suitable manner. The top and bottom portions 6 and 7 may have other suitable arrangements, such as each of the top and bottom portions having only a single protuberance, or each spacer portion having two or more protuberances.

Figure 3:
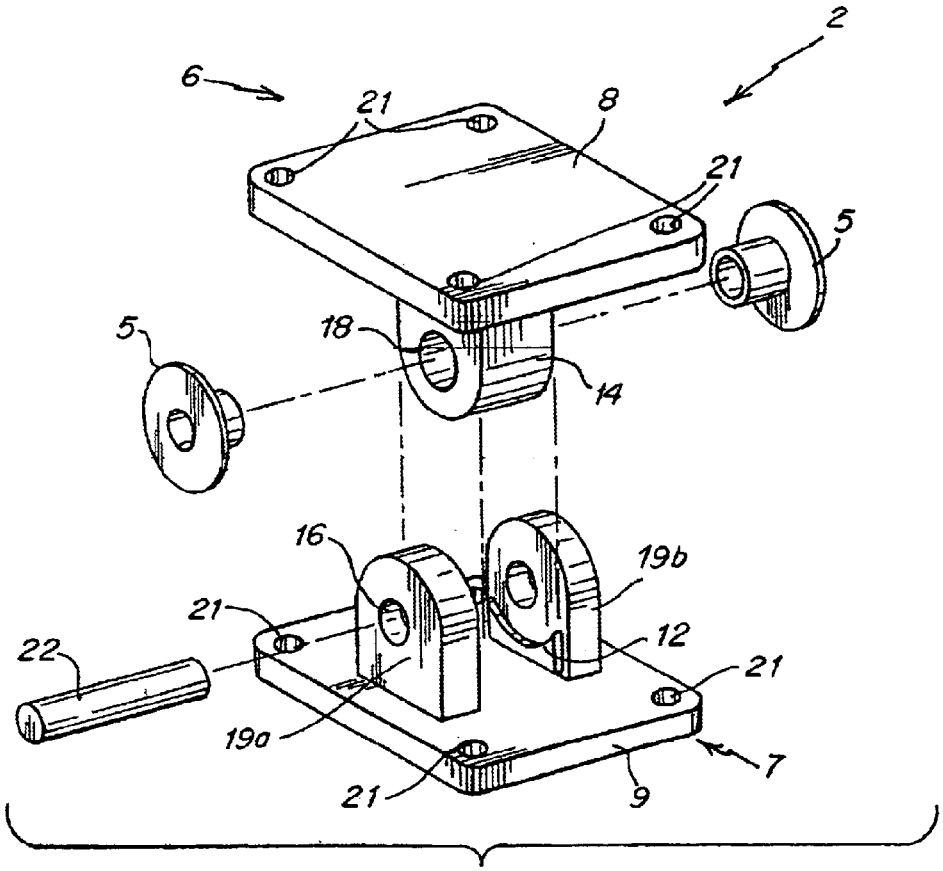
FIG. 3 is an exploded view of another spacer arrangement in accordance with the invention.

FIG. 3 shows an enlarged view of another illustrative embodiment of a spacer 2 in accordance with the invention. This embodiment is similar to the spacer 2 shown in FIG. 2 in that the embodiment in FIG. 3 has a top portion 6 with an insertion piece 14 and a bottom portion 7 with two protuberances 19*a* and 19*b* that receive the insertion piece 14. However, in this embodiment, bushings 5 are used to isolate the insertion piece 14 from the shaft 22. Tubular ends of the bushings 5 are inserted into the borehole 18 until the flat washer-like portions of the bushings 5 abut the sides of the insertion piece 14. Thus, when the insertion piece 14 and bushings 5 are inserted between the protuberances 19*a* and 19*b* and the boreholes 16 and 18 are aligned, the shaft 22, such as a bolt and nut, may be inserted through the boreholes 16 and the holes in the bushings 5. The bushings 5 may provide a wear surface for the shaft 22, protecting the borehole 18 from wear, and may be replaced if they become worn without requiring replacement of the top portion 6. The bushings may also isolate the shaft 22 from the top or bottom portions 6 and 7, e.g., to prevent electrochemical reactions or high wear between dissimilar metals, such as an aluminum top portion 6 and a steel shaft 22. Similar bushings or other bearing surfaces may be provided in the borehole 16 in the lower portion 7.

In this illustrative embodiment, the protuberances 19*a* and 19*b* may also include a support 12 that extends inwardly in from the protuberances 19*a* and 19*b*. The washer-like portions of the bushings 5 may rest on the support 12 and provide an additional bearing surface between the top and bottom portions 6 and 7. The support 12 may optionally extend further from the protuberances 19*a* and 19*b* so that the lower end of the insertion piece 14 may bear on the support 12 either in addition to, or instead of, the bushings 5 similar to that in the FIG. 2 embodiment.

In another illustrative embodiment, portions of a spacer may be made so as to interlock and allow pivoting without requiring a separate shaft or other element. For example, in the embodiment shown in FIG. 4, the top and bottom portions 6 and 7 are pivotally joined by integrated shaft elements 50 formed in the top portion 6 that engage with a borehole 18 or other opening in the bottom portion 7. Another feature different from the embodiments described above is that the bottom portion 7 includes an insertion piece 14 with a borehole 18, and the top spacer portion 6 includes a pair of protuberances 19*a* and 19*b* that depend downwardly and carry the integrated shaft elements 50. However, as described above, the relative positions of the insertion piece 14 and the protuberances 19 may be reversed. The baseplates 8 and 9 of the top and bottom portions 6 and 7 have a wing-like appearance in this embodiment, and the spacer 2 has an overall swept back design. Such design features may vary as desired or suitable. For example, the portions of the spacer 2 may also be configured to reduce resistance of air or snow flowing past the spacer 2, to provide various degrees of strength and/or flexibility, and so on.

Figure 4:
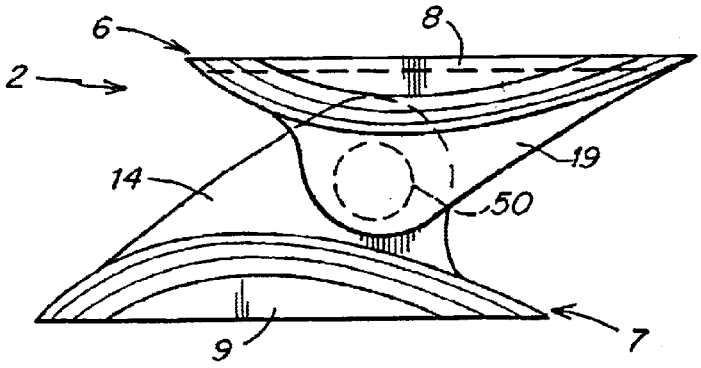
FIG. 4 is a side view of another illustrative embodiment of a spacer in accordance with the invention.
Figure 5:
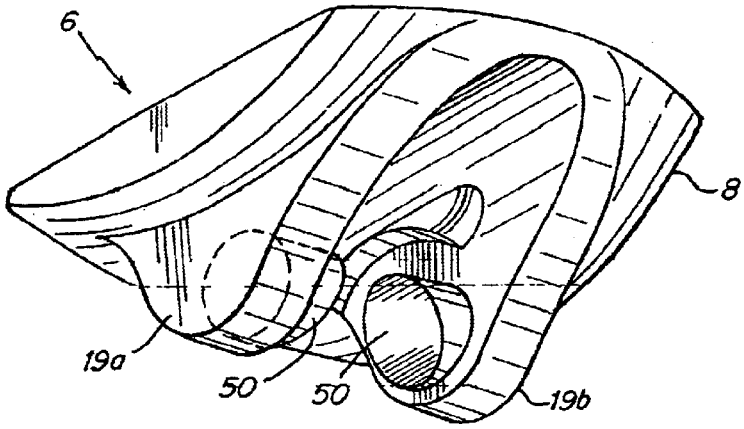
FIG. 5 is a perspective view of a top portion of the FIG. 4 embodiment.

FIG. 5 is a bottom perspective view of the top spacer portion 6 in the FIG. 4 embodiment and more clearly shows the integrated shaft elements 50 extending inwardly from the protuberances 19*a* and 19*b*. Although the shaft elements 50 in this embodiment are carried by the protuberances 19, the shaft elements 50 may be formed as part of the insertion piece 14 of the bottom portion 7 and inserted into respective boreholes in the top portion 6. The shaft elements 50 of this embodiment are shown as rectangular with rounded ends, but may be any suitable shape such as square, oval, circular or other. Other arrangements for attaching spacer portions together such that they may pivot are contemplated as should be appreciated by one of skill in the art.

Figure 6:
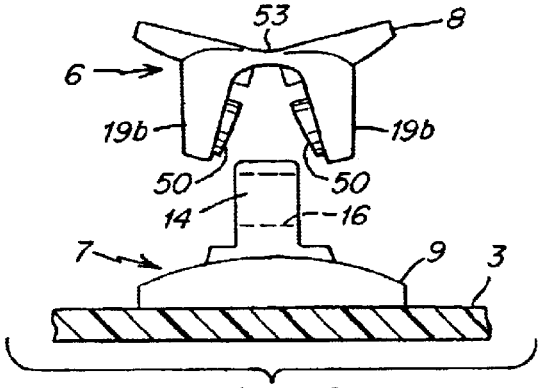
FIG. 6 is a front view of the embodiment of a spacer arrangement shown in FIG. 4 at one stage of assembly.
Figure 7:
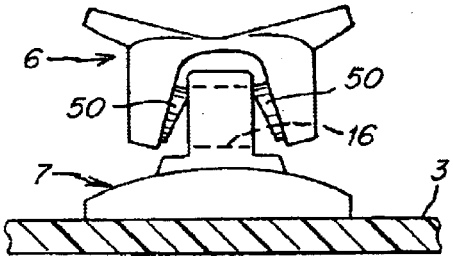
FIG. 7 is a front view of the FIG. 4 embodiment at another stage of assembly.
Figure 8:
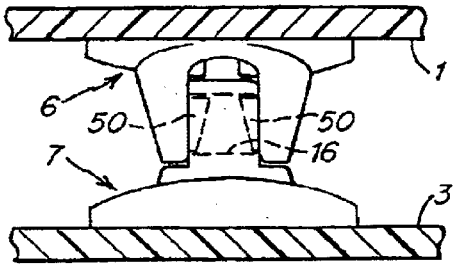
FIG. 8 is a front view of FIG. 4 embodiment at a final stage of assembly.

FIGS. 6, 7 and 8 show front views of the illustrative embodiment of FIGS. 4 and 5 at three stages of a representative assembly. To facilitate engagement of the top portion 6 with the bottom portion 7, the top portion 6 may include a hinge 53, e.g., a portion of the baseplate 8 of greater flexibility, such that the top portion 6 may be deformed and the shaft elements 50 spread apart for insertion into the borehole 16. Once spread apart, the shaft elements 50 may be inserted into the ends of the borehole 16 as shown in FIG. 7 and the baseplate 8 may be straightened and attached to the underside of the deck 1 as shown in FIG. 8. By securing the baseplate 8 to the deck 10, deformation of the baseplate 8 and withdrawal of the shaft elements 50 from the borehole 16 can be prevented. Any suitable method of separating the shaft elements 50 may be used as the method of attaching the spacer portions 6 and 7 together and is not meant to be a limiting feature of the invention. For example, the top portion 6 may be made as a two-part clam shell arrangement that may be separated along a line near where the hinge 53 is shown. When the halves are separated, the shaft elements 50 may be inserted into the borehole 16 and the halves again assembled, e.g., by screws or other fastening means. Attaching the clam shell halves together may secure the shaft elements 50 in the boreholes 16.

Figure 9:
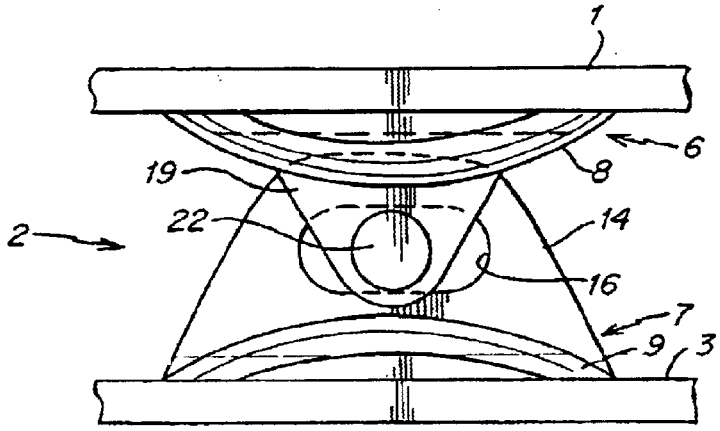
FIG. 9 is a side view of yet another illustrative embodiment of a spacer in accordance with the invention.

In another illustrative embodiment, a spacer may provide for relative sliding movement of the deck and runner. The sliding movement may be in a longitudinal or lateral direction and caused by flexing of the deck and/or runner during riding. In addition, sliding movement may be along linear, curved or other paths. As discussed above, the sliding movement may prevent large stresses from being formed in the connection areas between the spacers 2 and the deck 1 and/or runner 3, or may provide smoother riding characteristics since the runner 3 and deck 1 are allowed to flex more freely. FIG. 9 shows an illustrative embodiment in which a portion of the deck 1 may slide relative to a portion of the runner 3. In this embodiment, the spacer 2 is configured similarly to that in FIG. 4 with protuberances 19 depending from the baseplate 8 of the top portion 6, and an insertion piece 14 extending upward from the baseplate 9 of the bottom portion 7. Unlike the FIG. 4 embodiment, however, the top and bottom portions 6 and 7 are connected by shaft 22 that extends though boreholes in the protuberances 19 and the insertion piece 14. The borehole 16 in the insertion piece 14 is formed as a slot that extends in the front to back direction of the snowdeck 10, thereby allowing the shaft 22 and thus the deck 1 to slide longitudinally relative to the runner 3. When bending forces are applied to the deck 1 and/or the runner 3, the deck 1 and runner 3 may bend and slide longitudinally relative to each other. The allowance for longitudinal sliding can reduce shear forces within the spacers 2 and/or at the attachment areas between the spacers 2 and the deck 1 or runner 3.

The shaft 22 may roll, slide or move in any suitable way in the slot 16. In this embodiment, the shaft 22 has a circular cross section so that the top portion 6 may rotate relative to the bottom portion 7 in addition to sliding. However, the shaft 22 may have a square, rectangular or other cross section that allows the shaft 22 to slide, but not pivot, in the slot-shaped borehole 16. It should be understood that the shaft 22 may be connected at opposite ends to the protuberances 19 so that the shaft 22 is not free to rotate relative to the top portion 6 as well. Of course, the slot 16 may be formed in the protuberances 19, or in other any suitable portion of the spacer 2 in which the shaft 22 or other element can move. Similarly, the use of a shaft 22 is not required, as shaft elements 50 such as that in FIGS. 4 and 5 or the like may be used. The slot-shaped borehole 16 may be linear and parallel to the runner 3 and deck 1 as shown in FIG. 9, or may be curved or otherwise formed to allow the deck 1 to pivot, rotate or move in some other fashion relative to the runner 3. The connection between the top and bottom portions 6 and 7 may be arranged to prevent or at least reduce relative pivoting of the deck 1 and runner 3 around a front to back axis. This feature may provide for a more responsive snowdeck when turning since tilting force of the rider's feet on the deck 1 may be more efficiently transmitted to the runner 3.

Figure 10:
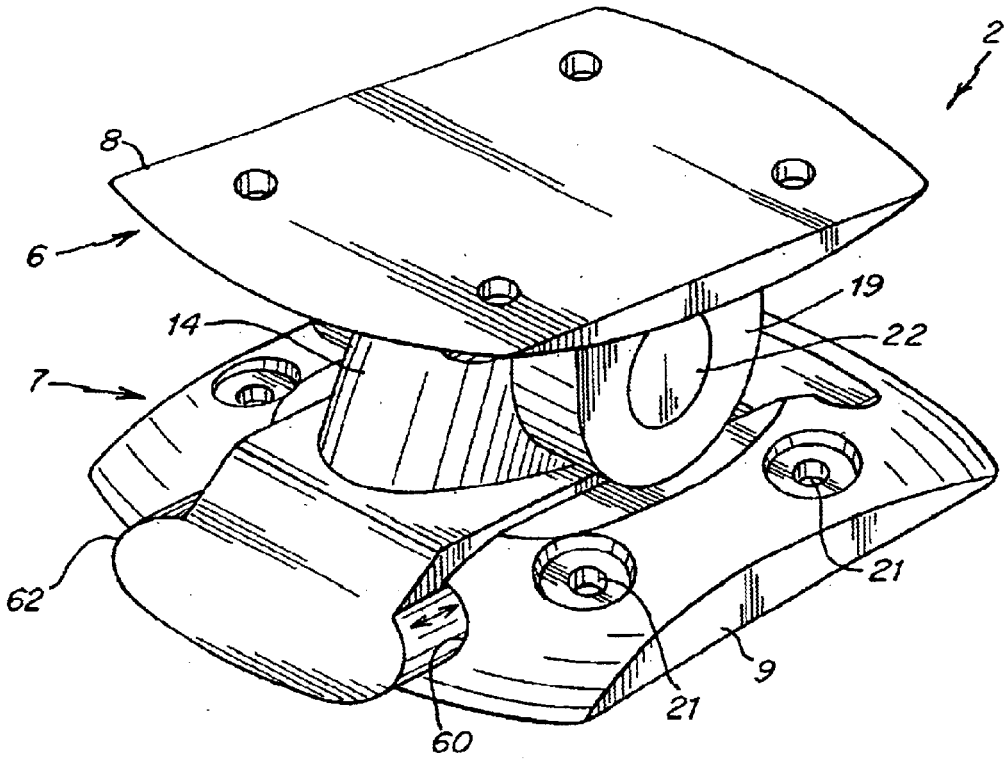
FIG. 10 is a perspective view of another embodiment of a spacer according to the invention.
Figure 11:
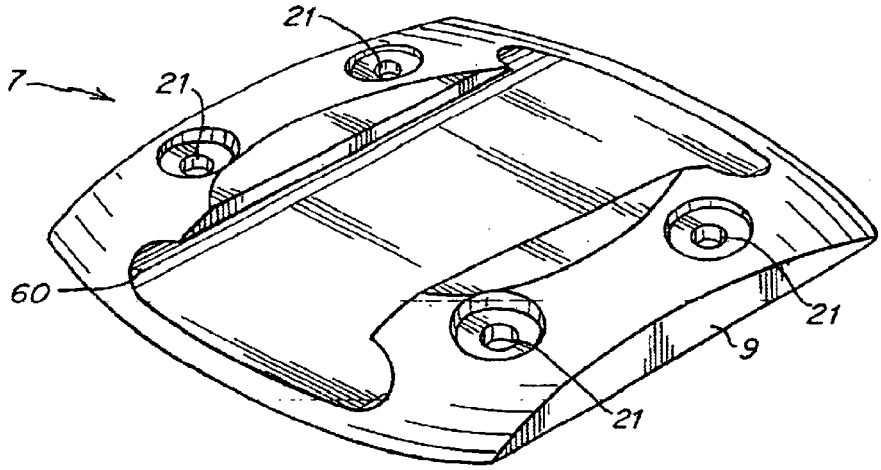
FIG. 11 is a perspective view of a lower portion of the spacer shown in FIG. 10.
Figure 12:
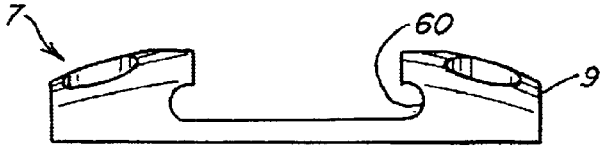
FIG. 12 is a front view of the spacer portion shown in FIG. 10.

FIG. 10 shows another illustrative embodiment of a spacer that allows for relative sliding of the deck 1 and runner 3 in a snowdeck 10. In this illustrative embodiment, a bottom portion 7 of the spacer 2 has a channel 60 in which a base 62 of an insertion piece 14 on the top portion 6 is slideable. FIGS. 11 and 12 show a perspective view and an end view, respectively, of the bottom portion 7 of the FIG. 10 embodiment. The channel 60 in this embodiment is shaped to dovetail with the base 62 of insertion piece 14 so that the base 62 may slide in the channel 60, but not be withdrawn upwardly from the channel 60. As will be evident to one of skill in the art, other arrangements may be used which allow one spacer portion to slide or move relative to another spacer portion. For example, the channel 60 may be incorporated into the top portion 6 of the spacer 2, or any other suitable component, including the deck 1 or runner 3. The channel 60 may limit the distance that the insertion piece 14 can slide in one or both directions within the channel 60, e.g., by a stop piece or other suitable structure. Alternately, the insertion piece 14 may be allowed to slide in the channel 60 unimpeded. The base 62 may alternately roll through a groove or channel with the aid of bearings, wheels, or other suitable rollers. An adjustment feature may allow the rider to optionally clamp or lock the base 62 in the channel 60, or otherwise prevent movement of the base 62 relative to the channel 60. Features may be included which provide a varying resistance to movement. It is important to note that the channel 60 is not limited to the disclosed embodiment, but may be any suitable structure that allows one spacer portion to move relative to another spacer portion or relative to one of the runner and the deck.

Figure 13:
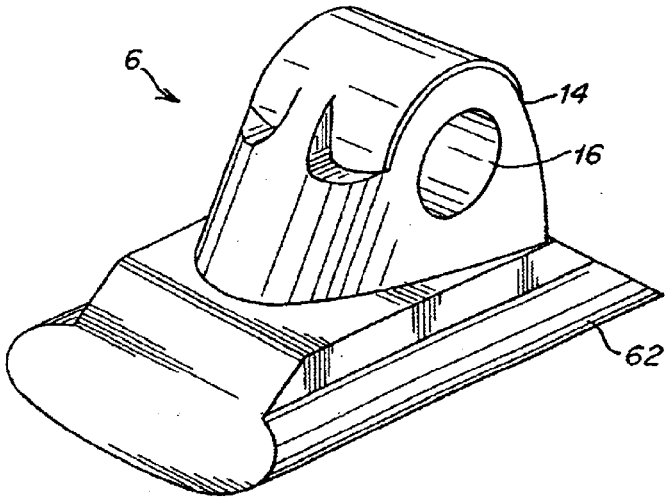
FIG. 13 is a perspective view of an upper portion of the spacer shown in FIG. 10.

FIG. 13 shows a part of the top portion 6 for use with the spacer shown in FIG. 10. In this illustrative embodiment, the top portion 6 includes an insertion piece 14 mounted to the base 62. The insertion piece may be connected to another portion of the spacer 2 in much the same way as in the embodiment of FIG. 2 or 3, e.g., a baseplate 8 having protuberances 19 depending from the baseplate 8 that are secured to the insertion piece 14 by a shaft inserted in the borehole 16. This arrangement may allow for both pivoting and sliding of the deck 1 and runner 3. Alternately, the base 62 may be rigidly connected to a baseplate 8 that is secured to the deck 1 or runner 3.

Figure 14:
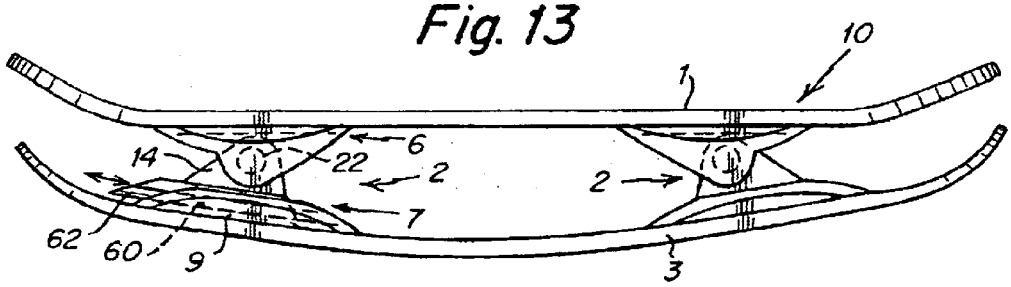
FIG. 14 is a side view of a snowdeck incorporating the spacer shown in FIG. 10.

FIG. 14 shows an illustrative embodiment of a snowdeck 10 incorporating a spacer 2 in accordance with the embodiment shown in FIG. 10. In this example, the runner 3 is bent or flexed while the deck 1 remains substantially straight—a situation which may result from the snowdeck 10 hitting a rock or other object or when performing a turn or other maneuver, for example. The spacer 2 on the left side of the snowdeck 10 is arranged to allow longitudinal movement and pivoting, while the spacer 2 on the right side allows pivoting only. To compensate for the movement of the runner 3, the base 62 slides in the channel 60. Of course, as discussed above, one or both of the spacers 2 may provide sliding and/or pivoting. The arrangement of spacers may also compensate for flexing or other movements of the deck 1 separately from or in addition to the movements of the runner 3.

Figure 15:
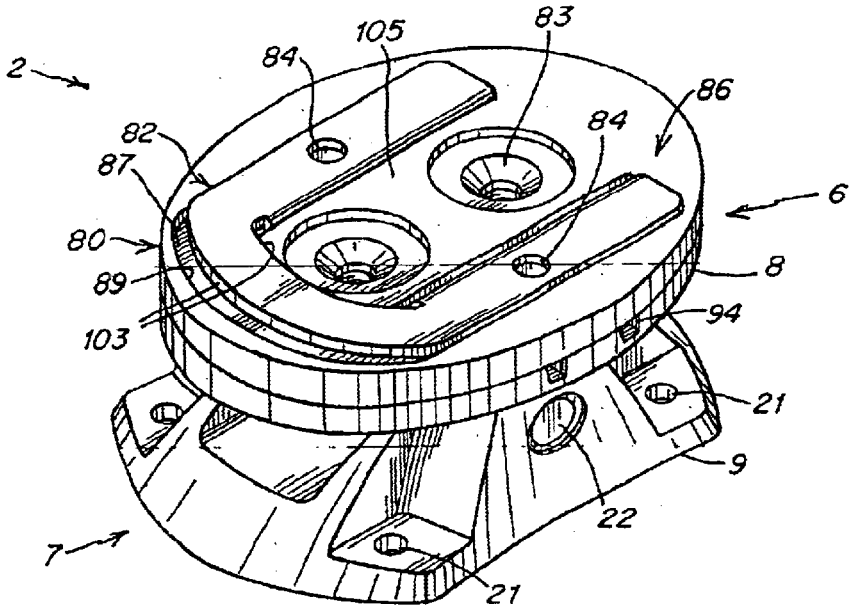
FIG. 15 is a perspective view of a spacer arrangement that includes a riser element.

FIG. 15 shows another illustrative embodiment of a spacer 2 capable of providing both relative pivoting and sliding of the deck 1 and runner 3. In this illustrative embodiment, the spacer 2 includes top and bottom portions 6 and 7 that are arranged like the embodiment shown in FIG. 3, and a riser element 80 secured to the top portion 6, although the riser portion 80 may be secured to the bottom portion 7 in alternate embodiments. The riser portion 80 may provide the ability to adjust the vertical separation of the deck 1 and runner 3, and may be made available in different heights. Riders may prefer one vertical spacing between the deck 1 and the runner 3 to other spacings because the vertical spacing between the deck 1 and runner 3 is one factor that determines the leverage available to a rider for tilting and turning the snowdeck 10 and may affect the snowdeck's stability. To adjust a vertical spacing, riser elements 80 of varying heights may be secured between the top spacer portion 6 and the deck 1. Although in this embodiment the riser element 80 is separate from the top portion 6 and the deck 1, the riser element 80 may be integral to the top portion 6, deck 1 or runner 3. Multiple riser elements 80 may be incorporated into a single spacer 2, and a riser element 80 may be used alone as a spacer 2 on a snowdeck, e.g., without the top and bottom portions 6 and 7.

In this embodiment, the riser element 80 is constructed and arranged to allow sliding of the deck 1 and runner 3 relative to each other. However, the riser element 80 need not allow such movement, and may be a single block of material that adds height to the spacer 2. A U-shaped channel member 82 in the riser element 80 may be attached to the underside of the deck 1 with bolts, screws or other suitable fasteners (not shown) inserted through holes 84. A slide piece 86 may be attached to the baseplate 8 of the top portion 6 via holes 83 and suitable fasteners. The slide piece 86 engages with the U-shaped channel member 82 so that the U-shaped channel member 82 may slide generally in the direction of the long legs of the U-shaped member 82. Although the channel member 82 and the slide piece 86 may engage in any suitable way, in this embodiment, a recess 87 in the slide piece 86 receives the U-shaped channel 82, and walls 89 of the recess 87 provide a limit on how far the U-shaped channel member 82 may move.

Figure 16:
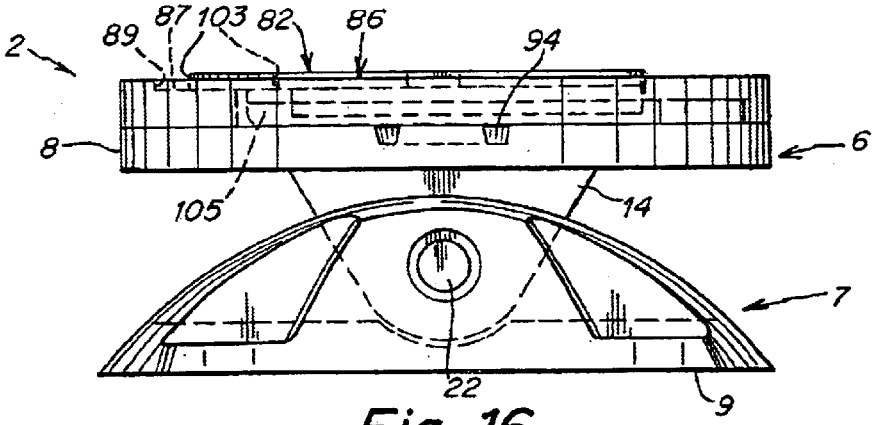
FIG. 16 is a side view of the FIG. 15 embodiment.

FIG. 16 shows a side view of the FIG. 15 embodiment. The top spacer portion 6 shown in FIG. 16 includes an optional groove 94 that forms a tether passage. The groove 94 has two openings at the edge of the top spacer portion baseplate 8 so that a tether or leash (not shown) can be looped through the passage and secured in place. As can also be seen in FIG. 16, the U-shaped channel member 82 may extend above the top surface of the slide piece 86 so that some amount of clearance may be present between the deck 1 and the slide piece 86. Some clearance between the deck 1 and the slide piece 86 may be required to allow sliding of the deck 1 relative to the runner 3.

Figure 17:
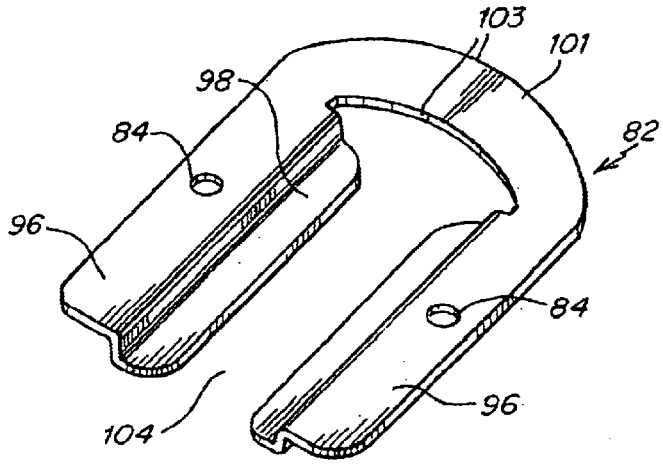
FIG. 17 is a perspective view of a channel member for the riser element shown in FIG. 15.

FIG. 17 shows an illustrative embodiment of the U-shaped channel member 82 separate from the slide piece 86. In this embodiment, the channel member 82 includes two arms 96 which are shaped to form a channel 98. A connection member 101 links the two arms 96 together. The connection member 101 provides vertical surface areas 103 that may contact the walls 89 of the recess 87 in the slide piece 86 to limit the range of travel of the channel member 82. The two arms 96 need not be linked by a connection member 101 as they may be attached separately to the deck 1, and the channel 98 may be formed with an open slot 104 as shown, or may be closed. The U-shaped channel member 82 may be formed from a stamped metal sheet or in any other suitable way or other material.

Figure 18:
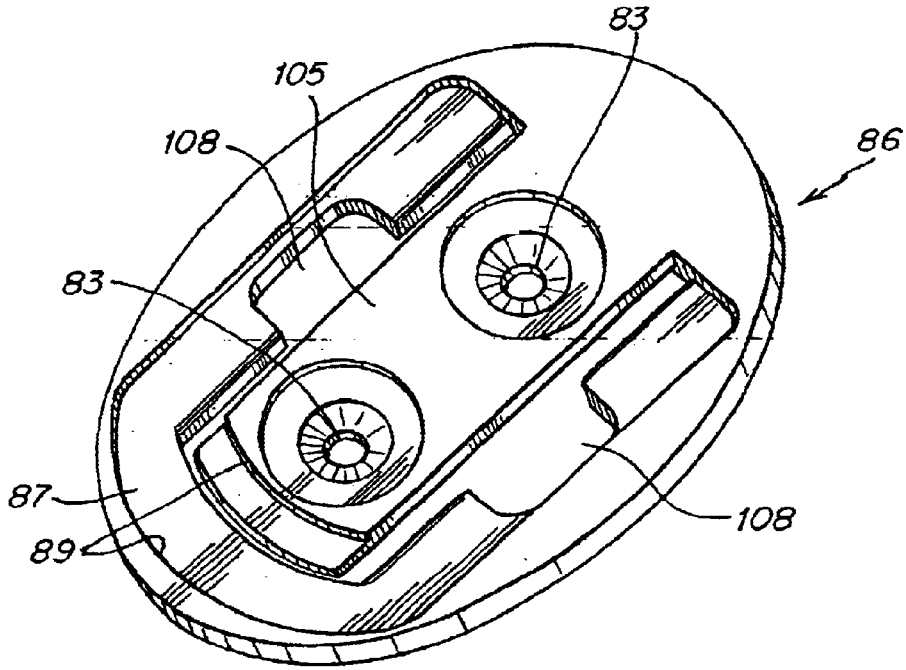
FIG. 18 is a perspective view of a slide piece in the riser element shown in FIG. 15.

FIG. 18 shows the slide piece 86 separate from the channel member 82. The slide piece 86 includes a slide rail 105 which interlocks with and is slidable within the channel 98 of the channel member 82. The slide rail 105 is cantilevered at one end from the main body of the slide piece 86. Two countersunk holes 83 are provided for bolts, screws or other suitable fasteners that attach the slide piece 86 to another portion of the spacer 2 or the runner 3. Two gaps 108 are provided in the slide piece 86 so that the bolt holes 84 of the channel member 82 can be accessed when the slide piece 86 and the channel member 82 are interlocked. The recess 87 that receives the channel member 82 can be seen more clearly in FIG. 18, and may be formed larger than the channel member 82 to allow the channel member 82 to move in the recess 87 relative to the slide piece 86. As mentioned above, the slide piece 86 need not be a separate piece of the spacer 2, but may be, for example, integral to the top portion 6, bottom portion 7, or other suitable portion of the spacer 2.

Figure 19:
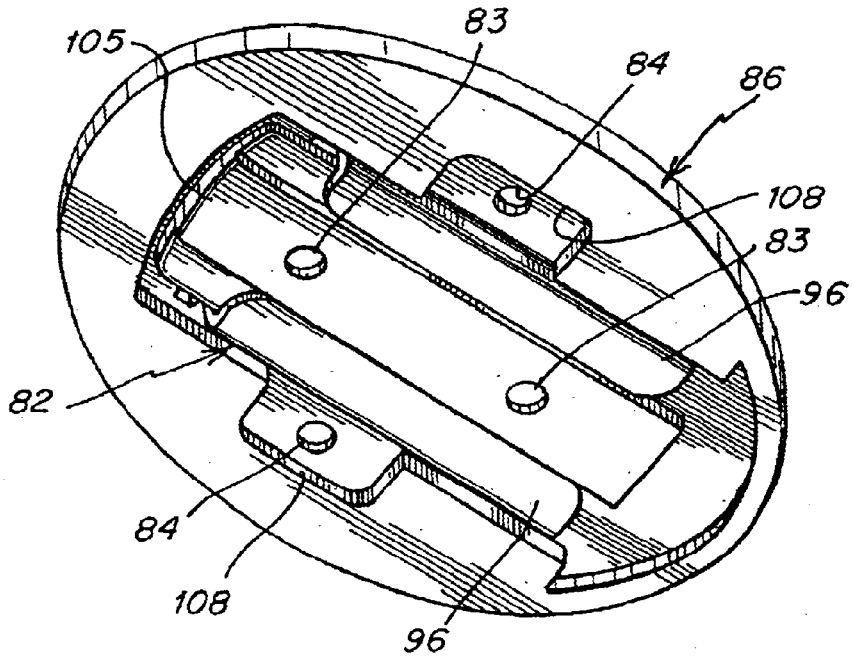
FIG. 19 is a bottom perspective view of the riser element having the slide piece interlocked with the channel member.

The slide rail 105 is inserted into the channel 98 of the channel member 82 by bending or otherwise moving the slide rail out of the primary plane of the slide piece 86 and inserting the slide rail 105 into the channel 98. The slide piece 86 and the channel member 82 are shown interlocked in FIG. 19, which shows the lower side of the riser element 80 that attaches to a spacer portion.

Figure 20:
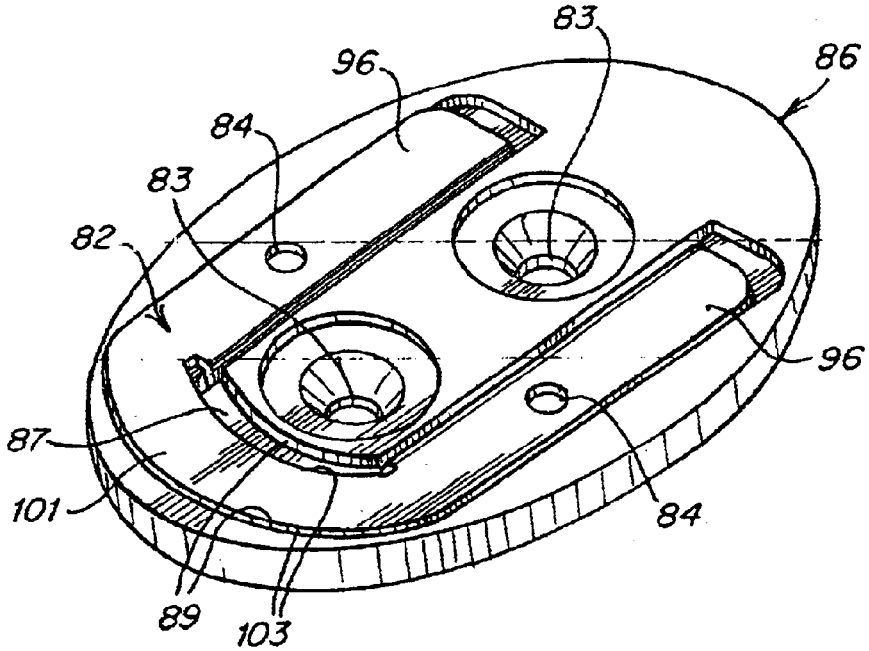
FIG. 20 is a top perspective view of the riser element.

FIG. 15 above shows the riser element 80 in a configuration in which the channel member 82 is at a rear position in the recess 87, and FIG. 20 shows the channel member 82 at a forward position in the recess 87. The total range of motion of the channel member 82 may vary as desired, e.g., from 1–10 mm or more. Although the embodiment above shows the channel member 82 secured to the deck 1, the channel member 82 may be secured to another spacer portion or the runner 3, and the slider piece 86 secured to the deck 1.

Figure 21:
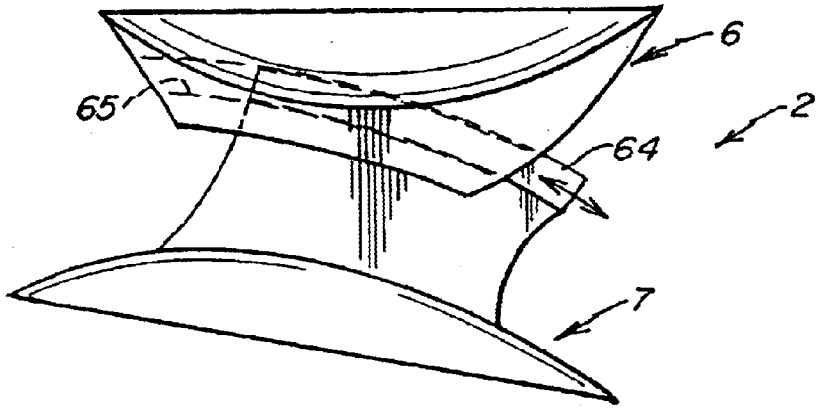
FIG. 21 is a side view of yet another embodiment of a spacer adapted to simultaneously slide and pivot.

In another illustrative embodiment, a spacer may provide pivoting and sliding movement that are interrelated. FIG. 21 shows one illustrative embodiment in which the bottom portion 7 of a spacer 2 has a sliding piece 64 that slides within a curved channel 65 in the top portion 6. The curvatures of the channel 65 and the sliding piece 64 allow the two spacer portions 6 and 7 to rotate relative to each other as they move relative to each other. Such an arrangement may increase the contact surface area between the two portions 6 and 7 while still allowing relative rotation of the deck 1 and the runner 3.

In other embodiments of the invention, the spacers 2 may provide a type of suspension or vibration control with springs or dampers. For example, one or more spacers 2 may include an elastomer material, such as a rubberized washer positioned between the spacers 2 and the deck 1 or runner 3. The washer or other element may serve to absorb vibrations that might otherwise be transmitted from the runner 3 through the spacers 2 to the deck 1.

Alternately, a shock dampening material may be incorporated into the structure of the spacers 2, or the spacer may even be formed substantially of an elastomer material. Such a construction may allow pivoting and/or movement of the deck and runner without moving parts. For example, the spacers 2 may be made of a resilient material that allows such movement or rotation, while preventing relative pivoting of the deck 1 and the runner 3 about a front to back axis. Thus, the suspension function described above may be provided by the spacers 2 while a rigid attachment between the deck 1 and runner 3 is still maintained so that sections of the two may not substantially pivot relative to each other about the front to back axis.

As further alternate arrangements, two spacers 2 in a snowdeck, such as that shown in FIG. 1, may be replaced with a single spacer 2, e.g., the single spacer may provide a suitably rigid attachment between the deck 1 and runner 3 while allowing desired pivotability, moveability, slideability or flexibility of sections of the deck 1 and/or runner 3 at the ends and/or at a mid-region of the deck 1 and runner 3. In another embodiment, the spacers 2 may be mounted along a centerline of the runner, or they may be mounted a lateral distance from the centerline. It is contemplated that this lateral positioning may be adjustable. Alternately, each spacer 2 may be divided into two spacers 2 so that pairs of spacers 2 are used at or near each end of the runner 3. Further, the spacers 2, or portions of the spacers 2, may be molded as part of the deck 1 and/or the runner 3 (e.g., the snowdeck, or a portion of the snowdeck, may be molded or otherwise formed as a single unitary structure). The deck 1, spacers 2 and runner 3 may be attached by an adhesive, welding, screws, rivets or any other suitable means.

While the deck 1 and runner 3 may be of any suitable lengths, in certain embodiments, the snowdeck 10 may include a runner 3 that is no more than 45 inches long, and in some embodiments is between 30 and 36 inches. In other embodiments, the ratio of the runner length to the deck length may be between 2/3 and 4/3, preferably between 2/3 and 1, with smaller ratios employed on snowdecks 10 used for jumps and tricks, and larger ratios employed on snowdecks 10 used for cruising. The deck 1 may be any suitable length, and in one embodiment, the deck 1 has a length of approximately 39 inches. The difference between the deck and runner lengths can be any suitable amount, but in some embodiments the difference may be no more than 13 inches such that the snowdeck 10 does not become unstable.

Although in the illustrative embodiments the snowdeck 10 does not include bindings or any other suitable device to physically attach one or more of the rider's feet to the deck 1, bindings, straps or other devices may be used to securely fasten the rider's feet. The snowdeck 10 may also include a leash, tether, rigid handle (similar to that on a scooter) (not shown) attached to the deck 1 or other portion of the snowdeck 10. The rider may hold the leash, handle or other device to help maintain balance on the snowdeck 10 or to pull the snowdeck 10 while walking.

The various components of the snowdeck 10, including the spacers 2, may be made using any suitable techniques, materials or processes. For example, the deck 1 may be made of wood, metal, plastic, a laminate or a composite material, such as plywood, or other, and may be constructed in much the same way as a typical skateboard deck.

The runner 3 may be made in a way similar to typical skis or snowboards and have metal edges, a plastic base material, vertical or horizontal wood laminate core or foam core material, and so on. An exemplary runner 3 would include a vertical laminate wood core surrounded by one or more layers of fiber laminate for torsional control. A sintered, extruded or graphite base is provided on the snow contacting surface of the runner 3 while a plastic, preferably opaque, top sheet for protecting the core and laminate from abrasion and from exposure to ultraviolet light is arranged on the opposite surface. Sidewall, cap or mixed sidewall/cap construction may be employed to protect the core. Stainless steel edges may be included to enhance edge grip. The runner 3 may be arranged with a fully distinct nose and tail for directional riding or, instead, with identical shaped tips (and flex patterns) at both ends for matched riding with either the tip or tail forward. The runner 3 may have a sidecut for ease of turning the sliding device. Preferably, the nose and tail will be upturned in a shovel arrangement.

In addition, the snowdeck 10 may be made as a single molded article, e.g., the deck 1, spacers 2 and runner 3 may be made together as a single integral unit. Alternately, portions of the snowdeck 10 may be made as a single integral unit, e.g., the deck 1 and the spacers 2 may be formed as an integral unit that is attached to a runner 3.

A method of producing a spacer for a sliding device also is provided. The method includes a step of providing spacer portions, such as a spacer portion that has a sliding piece and a base plate piece in which the sliding piece may move. The spacer portions may be constructed and arranged such that they are attachable to a deck or a runner of a snowdeck. The method may also include the step of connecting the portions together so that the two portions on the deck and the runner may rotate or pivot relative to each other.

A method of producing a bi-level sliding device also is provided. The method includes the step of providing a runner, a deck, and spacers. The spacers may be attached to the runner and the deck such that the deck may move in at least a linear direction relative to the runner without a change in attachment positions where the spacers are attached to the deck and/or runner.

While the invention has been described in conjunction with specific embodiments thereof, many alternatives, modifications, and variations will be apparent to those skilled in the art. Accordingly, embodiments as set forth herein are intended to be illustrative of the various aspects of the invention, not limiting. Various changes may be made without departing from the spirit and scope of the invention.

What is claimed is:

1. A sliding device for supporting a rider when sliding on a surface, comprising:

a runner having an upper surface, first and second ends, an intermediate portion between the ends, a width, and a length;

a deck elevated from the runner, the deck having a front to back direction, an upper surface that supports a rider, and a lower surface, wherein a width of at least a portion of the deck is greater than the width of the runner;

a first spacer secured to the runner at a runner attachment position and secured to the deck at a deck attachment position so that forces applied by a rider on the deck are transmitted to the runner, and so that the deck is restrained from pivoting about an axis running in the front to back direction; and a second spacer secured to the runner and the deck;

wherein at least one of the spacers is constructed and arranged to allow the runner and the deck to pivot in the front to back direction.

2. The sliding device of claim 1, wherein a portion of the deck is free to move in a front to back direction relative to the runner.

3. The sliding device of claim 1, wherein at least one of the spacers is constructed and arranged to allow a portion of the deck to move in the front to back direction relative to the runner.

4. The sliding device of claim 1, wherein the runner and deck are constructed and arranged to allow adjustment of one of the runner attachment position and the deck attachment position.

5. The sliding device of claim 1, wherein the runner is equally spaced vertically from the deck along the intermediate portion of the runner.

6. The sliding device of claim 1, wherein a length of the runner is at least approximately ⅔ a length of the deck.

7. The sliding device of claim 6, wherein the ratio of the width of the runner to the width of the deck is between approximately 0.4 and 0.8.

8. The sliding device of claim 1, wherein a length of the runner is at least approximately ¾ a length of the deck.

9. The sliding device of claim 1, further comprising an intermediate element that is secured between the first spacer and one of the deck and the runner.

10. The sliding device of claim 1, wherein the first spacer is constructed and arranged to allow front to back movement of a portion of the runner relative to the deck without the runner attachment position varying relative to the runner and without the deck attachment position varying relative to the deck.

11. The sliding device of claim 1, wherein the length of the runner is no more than approximately 4/3 a length of the deck.

12. The sliding device of claim 1, wherein the sliding device comprises only one runner.

13. The sliding device of claim 1, wherein the deck is constructed and arranged to support both feet of a rider.

14. The sliding device of claim 1, wherein the runner length is at most 45 inches.

15. The sliding device of claim 1, wherein the runner length and a deck length differ by at most 13 inches.

16. The sliding device of claim 1, wherein the first spacer comprises at least two portions, one portion attached to the deck and one portion attached to the runner, wherein one portion of the spacer is arranged to slide relative to the other portion when one of the deck and runner moves relative to the other of the deck and runner near the first spacer.

17. The sliding device of claim 16, wherein one portion of the first spacer slides linearly relative to the other portion.

18. The sliding device of claim 16, wherein one portion of the first spacer slides in an arcuate direction relative to the other portion.

19. The sliding device of claim 16, wherein the two portions of the first spacer interlock with each other.

20. The sliding device of claim 19, wherein one of the two portions includes a channel in which the other piece slides.

21. The sliding device of claim 1, wherein the first spacer comprises two portions that are arranged to slide relative to each other.

22. The sliding device of claim 21, wherein the first spacer comprises two spacer portions arranged to rotate relative to each other.

23. The sliding device of claim 1, wherein the first spacer comprises three portions, at least two of which are arranged slide relative to each other.

24. The sliding device of claim 23, wherein one portion of the spacer includes a channel in which another portion of the spacer is arranged to slide.

25. The sliding device of claim 23, wherein at least one of the three portions is arranged to rotate relative to another portion.

26. The sliding device of claim 1, wherein the first and second spacers provide an open space between the runner and the deck.

27. The sliding device of claim 1, wherein the length of the runner is no longer than a length of the deck.

28. The sliding device of claim 1, wherein the runner has a sidecut.

29. The sliding device of claim 1, wherein the runner does not include a device to attach at least one of a rider's feet to the deck.

30. The sliding device of claim 1, wherein at least one of the nose and tail is upturned.

31. The sliding device of claim 30, wherein the runner is constructed and arranged to allow riding with both the first end forward and the second end forward.

32. In a bi-level sliding device having a deck and a runner that extend in a front to back direction, a spacer, comprising:

a first portion constructed and arranged to be attached to the deck; and a second portion constructed and arranged to be attached to a runner and secured to the first portion such that forces applied by a rider on the deck may be transmitted to the runner;

wherein one of the first portion and the second portion includes a channel, and at least a portion of the other of the first portion and the second portion is arranged to move in the channel to allow for movement of one of the deck and the runner relative to the other such that the runner may flex at least partially independently of the deck during riding.

33. The spacer of claim 32, wherein the first portion and the second portion are arranged to pivot relative to one another as the part of the one portion moves in the channel.

34. The spacer of claim 33, wherein the channel is curved.

35. The spacer of claim 32, wherein the first portion and the second portion are arranged to pivot relative to one another.

36. The spacer of claim 32, further comprising at least one shaft element.

37. The spacer of claim 36, wherein the at least one shaft element is inserted into a borehole in one of the upper and lower portions.

38. The spacer of claim 32, wherein the channel extends in a linear direction.

39. The spacer of claim 32, wherein the first portion includes the channel, and a part of the second portion is arranged to move in the channel.

40. The spacer of claim 32, further comprising two pivotally attached portions adapted to be connected between one of the first and second portions and one of the deck and runner.

41. The spacer of claim 32, wherein the second portion includes the channel, and a part of the first portion is arranged to move in the channel.

42. The spacer of claim 41, wherein the channel extends in a linear direction.

43. In a bi-level sliding device having a deck and a runner that extend in a front to back direction, a spacer, comprising:

an upper portion;

a lower portion pivotally connected to the upper portion so that forces applied by a rider on the deck may be transmitted from the upper portion to the lower portion; and a riser element having at least two interlocking pieces that are arranged to slide relative to each other;

wherein one of the interlocking pieces in the riser element is adapted to be attached to one of the upper and lower portions and another of the interlocking pieces is adapted to be attached to one of the deck and the runner;

the riser element being adapted to allow relative sliding of the deck and runner and the upper and lower portions being adapted to allow relative pivoting of at least portions of the deck and runner.

44. The spacer of claim 43, wherein one of the upper and lower portions comprises at least two protuberances.

45. The spacer of claim 44, wherein the other of the upper and lower portions comprises an insertion piece that is received by the at least two protuberances.

46. The spacer of claim 45, further comprising a shaft that is received in aligned boreholes in the insertion piece and the at least two protuberances.

47. The spacer of claim 46, wherein at least a portion of each of the protuberances on one of the upper and lower portions are adapted to bear on a surface of the other of the upper and lower portions.

48. The spacer of claim 47, wherein the portions of the protuberances adapted to bear on a surface of the other of the upper and lower portions have a cylindrical shape.

49. The spacer of claim 46, wherein at least a portion of the insertion piece on one of the upper and lower portions is adapted to bear on a surface of the other of the upper and lower portions.

50. The spacer of claim 49, wherein the portion of the insertion piece has a cylindrical shape.

51. A method of producing a bi-level sliding device comprising:

providing a runner;

providing a deck wider than the runner;

providing first and second spacers;

attaching the first spacer to the runner and the deck; and attaching the second spacer to the runner and the deck at respective runner and deck attachment positions such that a portion of the deck may slide relative to the runner during riding without a change in runner and deck attachment positions relative to the runner and the deck.

52. The method of claim 51, wherein the step of attaching a first spacer comprises:

attaching the first spacer to the runner and the deck so that a portion of the deck may pivot relative to the runner.

53. The method of claim 51, wherein the step of attaching a second spacer comprises:

attaching the second spacer to the runner and the deck so that a portion of the deck may pivot relative to the runner.

54. A method of producing a bi-level sliding device comprising:

providing a runner;

providing a deck wider than the runner;

providing first and second spacers;

attaching the first spacer to the runner and the deck; and attaching the second spacer to the runner and the deck at respective runner and deck attachment positions such that a the deck may pivot relative to the runner in a front to back direction, and such that the deck is restrained from pivoting about an axis running in the front to back direction deck relative to the runner.

55. The method of claim 54, wherein the step of providing a runner and a deck comprises providing the runner and the deck such a length of the runner is at least approximately ⅔ a length of the deck.

56. The method of claim 54, wherein the step of providing a runner and a deck comprises providing the runner and the deck such a ratio of a width of the runner to a width of the deck is between approximately 0.4 and 0.8.

* * * * *